United States Patent [19]

Vernon et al.

[11] 4,425,224

[45] Jan. 10, 1984

[54] PROCESS FOR CONVERTING PETROLEUM RESIDUALS

[75] Inventors: Lonnie W. Vernon, Baytown; Fritz E. Jacobs; Richard F. Bauman, both of Houston, all of Tex.

[73] Assignee: Exxon Research and Engineering Co., Florham Park, N.J.

[21] Appl. No.: 336,665

[22] Filed: Jan. 4, 1982

[51] Int. Cl.[3] ..... C10G 45/58; C10G 47/34

[52] U.S. Cl. ..... 208/56; 208/107

[58] Field of Search ..... 208/56, 107

[56] References Cited

U.S. PATENT DOCUMENTS

| | | | |
|---|---|---|---|
| 2,768,936 | 10/1956 | Anderson, Jr. et al. | 208/108 |
| 3,008,897 | 11/1961 | Burk et al. | 208/251 H |
| 3,044,956 | 7/1962 | Burk et al. | 208/252 |
| 3,494,855 | 2/1970 | Stine et al. | 208/97 |
| 3,549,519 | 12/1970 | Munro et al. | 208/125 |
| 3,622,498 | 11/1971 | Stolfa et al. | 208/108 |
| 3,707,459 | 12/1972 | Mason et al. | 208/76 |
| 4,389,303 | 6/1983 | Simo et al. | 208/107 |

*Primary Examiner*—Patrick Garvin
*Assistant Examiner*—O. Chaudhuri
*Attorney, Agent, or Firm*—Wayne Hoover

[57] ABSTRACT

An improved process for hydrocracking petroleum residuals wherein total conversion and the yield of lower boiling range products are increased. The hydrocracking is accomplished in the presence of a hydrogen donor solvent comprising substantially all of the liquid product having an initial boiling point substantially equal to the final boiling point of the liquid product recovered from the hydrocracked product and, generally, within the range from about 600° F. to about 750° F. and molecular hydrogen. The conversion is accomplished at a pressure within the range from about 1500 to about 2500 psig and at a temperature within the range from about 800° to about 880° F. Operation at these conditions is essential to achieving the increased conversion and the increased yield of lower boiling liquid products.

10 Claims, 1 Drawing Figure

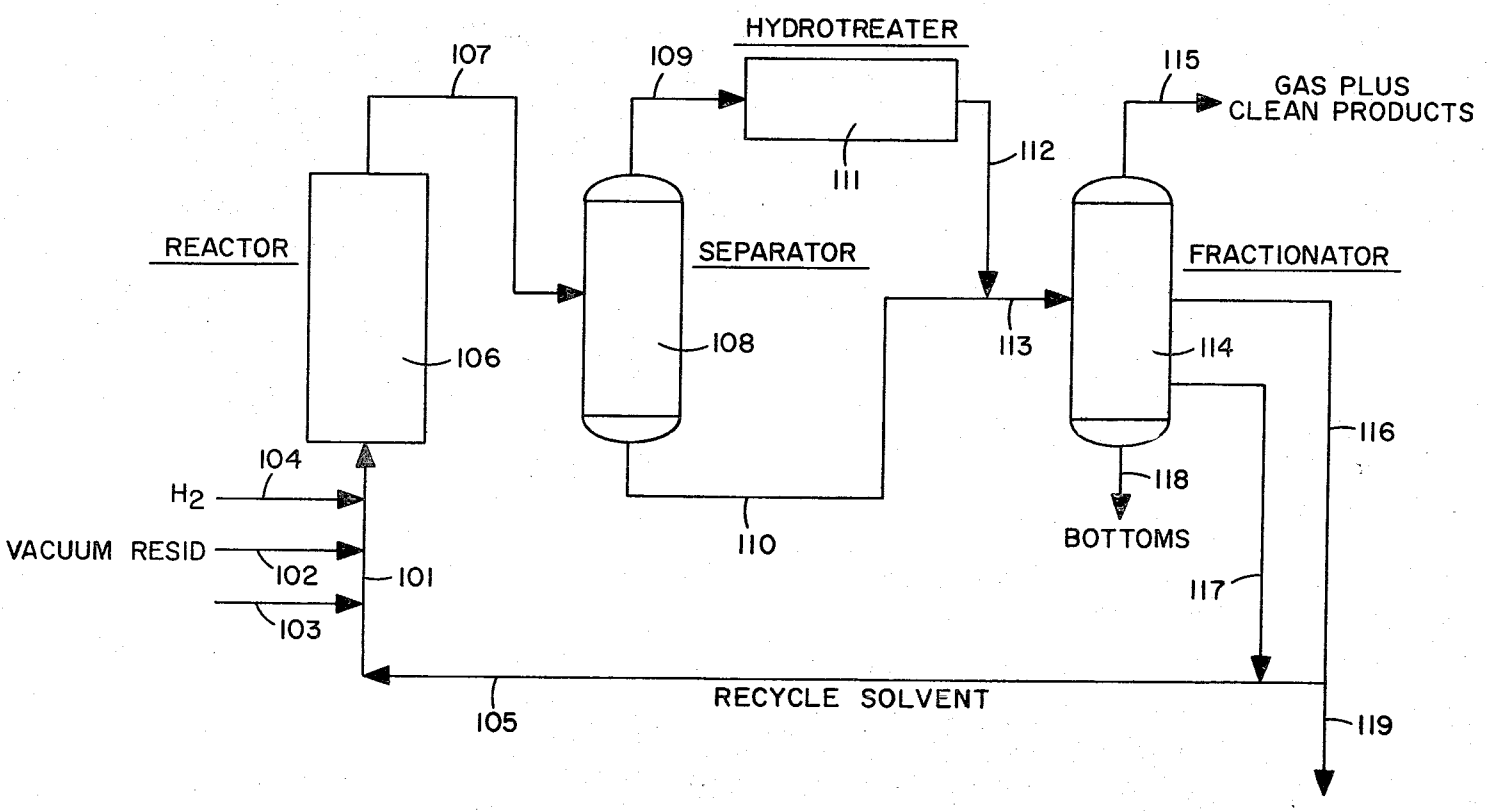
GAS PLUS
CLEAN PRODUCTS
115
FRACTIONATOR
114
116
119
118
BOTTOMS
117
112
113
HYDROTREATER
111
SEPARATOR
108
110
RECYCLE SOLVENT
109
107
106
105
101
REACTOR
104
102
103
H2
VACUUM RESID

PROCESS FOR CONVERTING PETROLEUM RESIDUALS

BACKGROUND OF THE INVENTION

This invention relates to an improved process for converting petroleum residuals. More particularly, this invention relates to an improved process for hydrocracking petroleum residuals.

Heretofore, several processes have been proposed for converting or demetalizing petroleum residuals. Such conversions and demetalizations may be accomplished over a relatively broad range of pressures and, generally, such conversions or demetalizations are accomplished at temperatures known to be effective in hydrocracking operations. It is known to effect such conversions or demetalizations in the presence of a solvent capable of donating hydrogen at the conditions employed to effect the conversion or demetalization and molecular hydrogen may or may not be present. The processes which have been proposed, heretofore, are used primarily for the purpose of upgrading the petroleum residuals such that the converted and demetalized product can satisfactorily be used as a feedstock to various petroleum processes such as catalytic cracking, hydrocracking and the like. As a result, however, the processes proposed heretofore have not resulted in significant conversion of the petroleum residual or in significant production of lighter boiling materials, particularly those in the naptha boiling range. The need, then, for an improved process for converting petroleum residuals to lighter products which may be used directly as a fuel is believed readily apparent.

SUMMARY OF THE INVENTION

It has now been discovered that the foregoing and other disadvantages of the prior art processes can be avoided with the method of the present invention and an improved process for converting petroleum residuals provided thereby. It is, therefore, an object of this invention to provide an improved process for the conversion of petroleum residuals. It is another object of this invention to provide such a conversion process wherein the total conversion of residuals is increased. It is still a further object of this invention to provide such an improved process wherein the relative yield of lighter boiling materials is increased. The foregoing and other objects and advantages will become apparent from the description set forth hereinafter and from the drawings appended thereto.

In accordance with the present invention, the foregoing and other objects and advantages are accomplished by converting a petroleum residual in the presence of molecular hydrogen and a hydrogen donor solvent at an elevated pressure and temperature. As pointed out more fully hereinafter, the total conversion of petroleum residual to lower boiling materials is increased by controlling the pressure within a relatively narrow critical range, by effecting the conversion in the presence of a hydrogen donor solvent containing at least 0.8 weight percent donatable hydrogen and by recycling substantially all of the liquid product having an initial boiling point within the range from about 600° F. to about 750° F. as all or a part of said solvent. The actual initial boiling point of this recycle fraction, which is sometimes referred to herein as heavy solvent or heavy solvent fraction, will depend upon the final boiling point of the product desired. In general, the improved process of this invention will yield a normally gaseous hydrocarbon product and a normally liquid product having an initial boiling point at or near atmospheric temperature and a final boiling point within the range from about 600° F. to about 750° F. As also pointed out more fully hereinafter, continuous operation of the process can be maintained by controlling the concentration of aromatic and hydroaromatic materials in the solvent relative to the amount of paraffinic materials therein.

BRIEF DESCRIPTION OF THE DRAWING

The FIGURE is a schematic flow diagram of a process within the scope of the present invention.

DETAILED DESCRIPTION OF THE INVENTION

As indicated, supra, the present invention relates to an improved process for converting petroleum residuals to lower boiling materials wherein total conversion of the petroleum residual and the yield of lighter boiling materials is increased. As indicated more fully hereinafter, it is critical to the present invention that the liquefaction be accomplished in the presence of a solvent containing at least about 0.8 weight percent donatable hydrogen at the time the solvent is fed to the conversion step; that all of the liquid product from the conversion stage having an initial boiling point equal to the final boiling point of the recovered product and within the range from about 600° F. to about 750° F. be used as all or part of said solvent; that the ratio of paraffinic materials to aromatic and hydroaromatic materials in the solvent be controlled such that the ratio is within the range from about 0:1 to about 0.5:1; and that the conversion be accomplished in the presence of molecular hydrogen at a partial pressure within the range from about 1500 to about 2500 psia.

In general, the method of the present invention can be used to convert any petroleum residual material. For purposes of this invention, petroleum residual material shall mean the material remaining after a crude oil has been processed to separate lower boiling constitutents. In general, the petroleum residuals will have an initial boiling point within the range from about 850° to about 1050° F. and will be normally solid at atmospheric conditions. The petroleum residuals will, however, be liquid at the conditions used to effect the conversion. The petroleum residuals may be derived or separated from essentially any crude including those generally classed as aromatic, napthenic and paraffinic. In general, the petroleum residuals useful in the method of this invention will be bottoms from a vacuum distillation column but the same could be any residual from a carbonaceous material having an initial boiling point within the range thereinbefore noted that is also liquid at the conditions used to effect the conversion.

In the method of the present invention, the petroleum residual will be combined with a solvent or diluent capable of donating hydrogen at the conditions employed to effect the conversion and containing at least 0.8 weight percent donatable hydrogen. The solvent is preferably a mixture of components, some of which are capable of donating hydrogen at the conversion conditions and some of which are not. At least a portion of the solvent will be a distillate fraction separated from the conversion liquid product and, depending on the particular petroleum residual subjected to conversion, this distillate fraction may be separately hydrotreated to produce components therein which are capable of donating hydrogen during conversion. In this regard, it should be noted that when the petroleum residual is highly aromatic, the distillate fraction will, generally, contain sufficient aromatic materials, that can be converted via hydrotreating to corresponding hydroaromatic materials to provide all of the donatable hydrogen required in the solvent. Moreover, by using all of the liquid product having an initial boiling point within the range of about 600° F. to about 750° F. as solvent, the amount of aromatics in the solvent fraction will be increased. Notwithstanding this, and when the petroleum residuals are primarily napthenic or paraffinic, however, it may be necessary to add aromatic and/or hydroaromatic materials to the distillate fraction which has been separated from the conversion product for use as a solvent but the amount of extraneous solvent required will, generally, be less when the heavy solvent fraction is used. Also, it may be necessary, particularly with paraffinic crudes, to remove at least a portion of the paraffinic material in the solvent fraction. When aromatics are added, separate hydrotreating will be necessary to convert at least a portion of the aromatics to corresponding hydroaromatics. When hydroaromatics are added directly, however, such separate hydrotreating will not be necessary. In this regard, it should be noted that an important feature of the present invention is the discovery that paraffins are the principal contributor to coke formation during conversion and that the presence of aromatics and hydroaromatics during such conversions either inhibit the formation of coke or solubilize the same to avoid plugging during conversion operations. Also, in a most preferred embodiment, use of a solvent having characteristics similar to the characteristics of the conversion product increases total conversion of the petroleum residuals. The use of a solvent which is a distillate fraction containing a relatively broad range of compounds is, therefore, particularly advantageous and when the petroleum residual is an aromatic, the solvent should contain aromatic materials, when the petroleum residual is napthenic, the solvent should contain napthenic materials and when the residual is paraffinic, the solvent should contain paraffins.

Compounds which will donate hydrogen during liquefaction are believed well-known in the prior art and many are described in U.S. Pat. No. 3,867,275. These include the indanes, the dihydronapthalenes, the $C_{10}$–$C_{12}$ tetrahydronapthalenes, the hexahydroflourines, the dihydro-, tetrahydro-, hexahydro- and octahydrophenanthrenes, the $C_{12}$–$C_{13}$ acid napthenes, the tetrohydro-, hexahydro-, and decahydropyrenes, the di-, tetra-, and octahydroanthracenes, and other derivates of partially saturated aromatic compounds. Particularly effective mixed solvents for use in the present invention include mixtures comprising a distillate fraction separated from the conversion product which is separately hydrotreated to convert at least a portion of the aromatic materials contained therein to the corresponding hydroaromatic components, hydrogenated creosote oils and hydrogenated catalytic cracking cycle stock and mixtures of such mixtures. Particularly effective solvents include distillate fractions of such mixtures having an initial boiling point within the range from about 350° to about 750° F. and a final boiling point within the range from about 850° to about 1050° F. which have been hydrogenated so as to contain at least 25 weight percent of hydrogen donor species and preferably at least 50 weight percent of such species.

In general, the petroleum residual and the solvent will be combined in a solvent-to-residual weight ratio within the range from about 0.5:1 to bout 2:1. The combination may be effected in accordance with any procedure obvious to one of ordinary skill in the art which will be effective in uniformly distributing the petroleum residual throughout the solvent. Best results are generally, however, obtained at elevated temperatures within the range from about 100° to about 350° F. in suitable mixing equipment.

In general, the amount of the liquid recycle solvent (heavy solvent) having an initial boiling point equal to the final boiling point of the recovered product and within the range from about 600° F. to about 750° F. will be sufficient to provide from about 20 weight percent to about 100 weight percent of the solvent required. The weight ratio of heavy solvent-to-petroleum residual will be within the range from about 0.2:1 to about 1.0:1. The remaining portion of the solvent, when necessary or desired, may be separated from the recovered product and recycled to the conversion step.

After the mixture of petroleum residual and solvent is prepared, the same is then subjected to conversion at a temperature within the range from about 800° to about 880° F. in the presence of molecular hydrogen. Generally, molecular hydrogen will be present at a concentration within the range from about 4 to about 8 weight percent based on petroleum residual and the partial pressure of molecular hydrogen will be within the range from about 1500 to about 2500. The mixture will be held at these conditions for nominal holding time within the range from about 30 to about 120 minutes.

During the conversion, at least a portion of the petroleum residual will be converted to a normally gaseous product and at least a portion will be converted to a normally liquid product. Generally, the liquid product will have an initial boiling point at or near the atmospheric temperature and a final boiling point equal to the initial boiling point of the petroleum residual and within the range from about 850° to about 1050° F. The liquid product may then be fractionated into any desired fractions for further upgrading or direct use as an end product provided that all of the heavier fraction, i.e., the fraction having an initial boiling point equal to the final boiling point of the desired product, is recycled as solvent. When only a naphtha fraction and a light distillate fraction are desired as product, the final boiling point of the liquid product desired will be within the range from about 600° F. to about 750° F. Unconverted material; i.e., material having a boiling point equal to or greater than the initial boiling point of the petroleum residual subjected to conversion may either be recycled to the conversion step, subjected to further conversion in a separate stage, burned directly as a fuel or discarded.

In general, and as indicated previously, a portion of the liquid product, including at least the heavy solvent fraction, will be separated and recycled to provide at least a portion of the solvent required to effect the conversion. When the separated fraction contains sufficient aromatics and/or hydroaromatics, it will not be necessary to combine this fraction with any extraneous solvent fractions. To the extent that the separated fraction contains primarily aromatics, this fraction may be subjected to hydrotreating to convert at least a portion of the aromatics to a corresponding hydroaromatic material. When this fraction does not, however, contain sufficient aromatic or hydroaromatic materials, it will be necessary to combine the same with an extraneous solvent fraction to produce a solvent having an aromatic/hydroaromatic concentration within the ranges heretofore specified. A catalytic cracking recycle oil is a particularly preferred extraneous fraction to employ since this oil is particularly high in aromatic materials. Creosote oils may also be used as an extraneous solvent fraction since these oils, too, generally, contain significant concentrations of aromatic materials.

PREFERRED EMBODIMENT

In a preferred embodiment of the present invention, the petroleum residual will be converted at a temperature within the range from about 820° to about 845° F. in the presence of a solvent capable of donating at least about 1.0 weight percent hydrogen. based on petroleum resid in the initial mixture of petroleum resid and solvent, and in the presence of molecular hydrogen at a hydrogen partial pressure within the range from about 1700 to about 2200 psia. In the preferred embodiment, the petroleum residual will be maintained at these conditions for a nominal holding time within the range from about 60 to about 90 minutes. Also in the preferred embodiment, the solvent will contain at least 60 weight percent aromatic and hydroaromatic components and the ratio of paraffinic materials to aromatic and hydroaromatic materials will be within the range from about 0:1 to about 0.25. In a preferred embodiment, the aromatic and hydroaromatic materials will be contained in a distillate fraction of the conversion liquid product and the solvent will contain all the liquid product having an initial boiling point within the range from about 650° F. to about 700° F., depending upon the cut point selected for the final boiling point of a light distillate product. In a most preferred embodiment, a petroleum residual containing sufficient aromatic materials will be subjected to liquefaction and a sufficient concentration of aromatic materials will be present in a distillate fraction separated from the conversion liquid product and the required hydroaromatic concentration will be provided by hydrotreating this fraction to convert at least a portion of the aromatic materials to corresponding hydroaromatic materials. Any suitable catalyst may be used during the hydrotreating.

It is believed that the invention will be even better understood by reference to the attached FIGURE which illustrates a particularly preferred embodiment. Referring then to the FIGURE, a petroleum resid, a suitable solvent and molecular hydrogen are fed into mixing manifold 101 through lines 102, 103 and 104, respectively. The petroleum resid will be introduced at a temperature above the temperature at which the same is liquid and pumpable, generally at a temperature within the range from about 100° to about 350° F. In general, any suitable solvent may be introduced through line 103 to effect "start up" of a commercial operation but at steady state recycle solvent comprising all of the liquid product having an initial boiling point equal to the final boiling point of the recovered product, generally between about 600° F. and about 750° F. will be introduced through line 105 and only makeup or extraneous solvent will be introduced through line 103. Extraneous solvent will, of course, be introduced when the recycle solvent introduced through line 105 is deficient in aromatic and/or hydroaromatic content. To the extent that hydroaromatic materials are introduced through line 103, the solvent will, preferably, be a hydrogenated creosote oil or a hydrogenated catalytic cracking cycle stock. In general, the solvent and molecular hydrogen will be preheated to a temperature within the range from about 800° to about 850° F. In general, the solvent will contain sufficient donatable hydrogen to provide at least 0.4 weight percent donatable hydrogen based on petroleum resid in the initial mixture and the combined aromatic/hydroaromatic concentration in the solvent will be at least 50 weight percent. The solvent will be combined with a petroleum resid in a ratio within the range from about 0.5:1 to about 2:1, preferably from about 1:1 to about 1.5:1 such that the weight ratio of heavy solvent-to-resid is within the range from about 0.2:1 to about 1.0:1, preferably from about 0.5:1 to about 0.7:1, and hydrogen will be added at a rate within the range from about 4 to about 8 weight percent based on petroleum residual in the initial mixture.

After mixing in mixing manifold 101, the petroleum resid, solvent and molecular hydrogen mixture is fed to conversion reactor 106. In the conversion reactor, the mixture is heated to a temperature within the range from about 800° to about 880° F. at a hydrogen partial pressure within the range from about 1500 to about 2500 psig and at a total pressure within the range from about 1800 to about 2800 psig. The nominal holding time in conversion reactor 106 will range from about 30 to about 120 minutes. In the conversion reactor, at least a portion of the petroleum resid will be converted to a normally gaseous product and at least a portion will be converted to a normally liquid product. Generally, at least a portion of the petroleum resid will remain unconverted.

In the embodiment illustrated, the entire conversion product is withdrawn through line 107 and passed to a first separator 108. In the first separator, a product containing the normally gaseous product and all of the liquid product which is to be recycled as solvent is separated overhead through line 109 and a bottoms product is separated through line 110.

In those embodiments where the recycle solvent will contain aromatics, the fraction withdrawn overhead through line 109 is passed to hydrotreater 111. In the hydrotreater, at least a portion of the aromatic materials are converted to corresponding hydroaromatic materials. Such conversion is believed to be well known in the prior art. Normally, such hydrotreatment will be accomplished at a temperature within the range from about 600° F. to about 950° F., preferably at a temperature within the range from about 650° F. to about 800° F. and at a pressure within the range from about 650 to about 2000 psia, preferably 1000 to about 1500 psia. The hydrogen treat rate during such hydrotreating generally will be within the range from about 1000 to about 10,000 scf/bbl. Any of the known hydrogenation catalyst may be employed, but a "nickel moly" catalyst is most preferred.

In the embodiment illustrated, then, the hydrotreated fraction is withdrawn through line 112 and recombined with the bottoms fraction from separator 108 in line 113. The recombined fractions are then passed to a second separator 114.

In the second separator 114, products boiling below the initial boiling point of the solvent fraction, including normally gaseous materials, are separated overhead through line 115, a light distillate fraction, a portion of which may be used as recycle solvent, is withdrawn through line 116, a fraction having an initial boiling point equal to the higher boiling point of the light distillate fraction is withdrawn through line 117 and a bottoms product generally having an initial boiling point equal to the initial boiling point of the petroleum resid subjected to conversion is withdrawn through line 118. In general, the light distillate fraction, a portion of which may be recycled as solvent will have an initial boiling point within the range from about 350° to about 450° F. and preferably an initial boiling point within the range from about 400° to about 450° F. and, generally, a final boiling point within the range from about 600° to about 750° F. and preferably a final boiling point within the range from about 650° to about 700° F. In all embodiments, at least a portion of this fraction will be withdrawn as product through line 119 and the remainder, when necessary or desirable, recycled as solvent through line 105.

It will be appreciated that while hydrotreating has been illustrated on a relatively broad boiling range product and between a first and second separator, the hydrotreating could be accomplished after the solvent fraction has been separated from the second separator through line 116 and 118. As is well known in the prior art, however, hydrogenation does alter the boiling range of the solvent and further separation after hydrogenation affords better control over the boiling range of the solvent fraction. As a result, operation in the manner illustrated in the FIGURE is preferred.

The overhead product withdrawn through line 115 may be further separated into a normally gaseous product and a liquid product boiling, generally, in the naphtha range; i.e., having an initial boiling point at or near atmospheric temperature and a final boiling point within the range from about 350° F. to about 450° F. The gas may be scrubbed to remove impurities and used as a pipeline gas or as a process fuel. The naphtha fraction may be further upgraded in accordance with well-known procedures to yield a high quality gasoline. The light distillate fraction withdrawn through line 119 boils, generally, within the known fuel oil ranges and may be used as such or further upgraded and used either as a diesel fuel or as a fuel oil. As previously indicated, the material withdrawn through line 117 boils, generally, within the vacuum gas oil range and will be recycled as solvent. The bottoms product withdrawn through line 118 may be at least partially recycled to the conversion reactor, burned for fuel value or discarded.

Having thus broadly described the present invention and a preferred embodiment thereof, it is believed that the same will become more apparent by reference to the following example. It will be appreciated, however, that the example is presented solely for purposes of illustration and should not be construed as limiting the invention.

EXAMPLE 1

In this example, a series of runs were completed in an autoclave at a temperature of 840° F., a nominal holding time of 80 minutes and in the presence of molecular hydrogen at a total pressure of 2000 psig using a solvent separated from liquid products from earlier autoclave runs having an initial boiling point of about 350° F. and a final boiling point of about 1000° F. In each of the runs of the series as well as the earlier runs, a vacuum petroleum residual obtained from a pipestill processing a heavy Arab crude and having a nominal initial boiling of about 1000° F. was used. The solvent was separately hydrogenated to contain about 1.0 weight percent donatable hydrogen and was used in all runs at a weight ratio of 1.5:1 based on petroleum resid, The ratio of heavy solvent-to-resid (650°/1000° F.) and the net yield of 650°/1000° F. liquid product for each run is summarized in the following table.

| Run No. | Weight Ratio Heavy Solvent:Resid | Net Yield of 650/1000° F. Wt. Resid |
|---|---|---|
| 1 | ca. 0.08 | ca. 19 |
| 2 | ca. 0.14 | ca. 20 |
| 3 | ca. 0.9 | ca. −5 |
| 4 | ca. 1.04 | ca. −5 |

For the purposes of comparison, when a solvent comprising all 350°/650° F. material is used, a net yield of 650° F./1000° F. material is about 25 weight percent based on resid.

From the foregoing, it is believed apparent that for the resid used in this example and at the conditions used herein, a net yield of zero 650°/1000° F. material would be realized when the ratio of heavy solvent (650°/1000° F.) to resid is about 0.7:1.

The effect of recycling the heavier portion of the normally liquid product is believed to be further illustrated in a U.S. patent application entitled "Improved Process for Converting Heavy Hydrocarbons (CP-181)" Ser. No. 336,535 filed in the name of Lonnie W. Vernon on or about the same date as this application, the disclosure of which is hereby incorporated by reference. The advantages of this invention are also further illustrated in a U.S. patent application entitled "Improved Process for Converting Hydrocarbon Residuals (CP-180)" Ser. No. 336,977 filed in the names of Lonnie W. Vernon and Fritz E. Jacobs on or about the same date as this application, the disclosure of which is also hereby incorporated by reference.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. A process for converting petroleum residuals having an initial boiling point within the range from about 850° F. to about 1050° F. comprising the steps of:

(a) combining a petroleum residual with a solvent comprising at least 0.8 weight percent donatable hydrogen and substantially all of the heavy solvent fraction separated in step (c) in a concentration sufficient to provide at least 0.4 weight percent donatable hydrogen based on petroleum residual in the initial mixture;

(b) converting the mixture from step (a) in the presence of molecular hydrogen at a hydrogen partial pressure within the range from about 1500 to about 2500 psig and at a temperature within the range from about 800° to about 880° F. for a nominal holding time within the range from about 30 to about 120 minutes thereby converting at least a portion of said petroleum residual to a normally gaseous product and at least a portion thereof to a normally liquid product;

(c) fractionating the normally liquid product into a desired liquid product fraction having a final boiling point within the range from about 600° F. to about 750° F. and a heavy solvent fraction having an initial boiling point equal to the final boiling point of the desired liquid product fraction and a final boiling point equal to the initial boiling point of said petroleum residual;

(d) recovering the desired liquid product fraction; and (e) using the heavy solvent fraction in step (a).

2. The improvement of claim 1 wherein at least a portion of the solvent is a distillate fraction having an initial boiling point within the range from about 350° F. to about 450° F.separated from the normally liquid product from the conversion.

3. The improvement of claim 1 wherein said solvent comprises materials selected from the group consisting of paraffinic materials, aromatic materials and hydroaromatic materials and the ratio of paraffinic material to aromatic and hydroaromatic material in said solvent is within the range from about 0 to about 0.5.

4. The improvement of claim 3 wherein the solvent contains at least 50 weight percent aromatic plus hydroaromatic materials.

5. The improvement of claim 1 wherein the petroleum residual is a vacuum residual an having initial boiling point within the range from about 950° to about 1050° F. separated from an aromatic crude.

6. The improvement of claim 1 wherein the heavy solvent fraction is the sole solvent used.

7. The process of claim 1 wherein the petroleum residual is a vacuum residual separated from a napthenic crude and a hydrogenated catalytic cracking recycle oil is used as at least a portion of the solvent.

8. The process of claim 1 wherein the petroleum residual is a vacuum residual separated from a napthenic crude and having an initial boiling point within the range from about 950° to about 1050° F. and wherein a hydrogenated creosote oil is used as at least a portion of the solvent.

9. The process of claim 1 wherein the petroleum residual is a vacuum residual separated from a paraffinic crude and a hydrogenated catalytic cracking recycle oil is used as at least a portion of the solvent.

10. The process of claim 1 wherein the petroleum residual is a vacuum residual separated from a paraffinic crude and having an initial boiling point within the range from about 950° to about 1050° F. and wherein a hydrogenated creosote oil is used as at least a portion of the solvent.

* * * * *